US006030280A

United States Patent [19]

Fruitman

[11] Patent Number: 6,030,280

[45] Date of Patent: Feb. 29, 2000

[54] APPARATUS FOR HOLDING WORKPIECES DURING LAPPING, HONING, AND POLISHING

[75] Inventor: Clinton Fruitman, Chandler, Ariz.

[73] Assignee: Speedfam Corporation, Chandler, Ariz.

[21] Appl. No.: 08/899,180

[22] Filed: Jul. 23, 1997

[51] Int. Cl.[7] ..... B24B 5/00

[52] U.S. Cl. ..... 451/291; 451/397; 451/398; 451/400; 451/402

[58] Field of Search ..... 451/262, 269, 451/397, 398, 400, 402

[56] References Cited

U.S. PATENT DOCUMENTS

| | | | |
|---|---|---|---|
| 3,662,498 | 5/1972 | Caspers . | |
| 4,805,348 | 2/1989 | Arai et al. . | |
| 4,883,716 | 11/1989 | Effenberger et al. . | |
| 4,916,868 | 4/1990 | Wittstock . | |
| 4,974,370 | 12/1990 | Gosis . | |
| 5,085,009 | 2/1992 | Kinumura et al. . | |
| 5,099,614 | 3/1992 | Arai et al. . | |
| 5,205,077 | 4/1993 | Wittstock . | |
| 5,484,637 | 1/1996 | Paragon et al. | 428/66.6 |

OTHER PUBLICATIONS

Patent Abstracts of Japan, vol. 012, No. 190 (M–704), Jun. 3, 1988 & JP 62 297064 A (Rodeele Nitta KK) Dec. 24, 1987.

Patent Abstracts of Japan, vol. 095, No. 002, Mar. 31, 1995 & JP 06 304859 A (Speedfam Co. Ltd.), Nov. 1, 1994.

Patent Abstracts of Japan, vol. 010, No. 122 (M–476), May 7, 1986 & JP 60 249568 A (Sumitomo Denki Kogyo KK), Dec. 10, 1985.

*Primary Examiner*—David A. Scherbel
*Assistant Examiner*—Benjamin Halpern
*Attorney, Agent, or Firm*—Snell & Wilmer LLP

[57] ABSTRACT

The present invention relates generally to a device used to process workpieces. In particular, the invention relates to a carrier that is used to support a workpiece during workpiece honing, grinding, or polishing. The carrier includes a rigid core coated with a fiber-free, scratch-resistant material to prevent scratching of workpieces disposed in the carrier. An adhesive layer is typically used to attach the scratch-resistant layer to the rigid core. The adhesive film and the scratch-resistant films may be attached to the rigid core by hot pressing.

6 Claims, 2 Drawing Sheets

APPARATUS FOR HOLDING WORKPIECES DURING LAPPING, HONING, AND POLISHING

TECHNICAL FIELD

The instant invention relates, generally, to an apparatus for lapping, honing, and polishing workpieces, and more particularly, to a carrier used to hold workpieces such as discs and wafers during the lapping, polishing, and grinding processes.

BACKGROUND ART AND TECHNICAL PROBLEMS

The processing of workpieces such as semiconductor wafers and magnetic discs often includes processes such as polishing, honing, lapping, or grinding. Flat honing, lapping, and polishing (hereinafter referred to as honing) typically involve passing a surface of a workpiece over a honing member such as a honing stone, a grinding stone, or a polishing pad. In addition to the honing member, a polishing or grinding agent may be present during the honing process. Examples of polishing or grinding agents include slurries, lubricants and water.

A carrier is often used to support the workpiece during the honing process. The carrier is generally configured to work in conjunction with a particular honing machine. A typical carrier has an aperture or recess configured to receive a workpiece. In addition, the carrier generally has gear teeth that correspond to gear teeth on one or more drive wheels of the honing machine. In this case, the honing or grinding occurs when the gear teeth on the drive wheels of the honing machine cause the workpiece carrier to move relative to the honing member. Typically, the movement of the carrier may be translational, rotational, or a combination thereof. A typical carrier is disclosed in U.S. Pat. No. 5,085,009, issued on Feb. 4, 1992 to Kinumura et al.

During the polishing process, one or more workpieces typically resides within the aperture(s) formed in the carrier. As the diameters of the apertures in the carriers are usually slightly larger than the outside diameters of the workpieces, the workpieces often move slightly within the apertures during polishing. If the material of which the carrier is constructed is harder than the material of which the workpiece is constructed, such movement may cause the surface of the workpiece to become undesirably scratched. Accordingly, it would be desirable to fabricate the carrier from a soft, flexible material, but softer materials often cannot withstand the stress of a polishing or honing process. Therefore, it is desirable to coat the inside edge of a stiff carrier with a material resistant to damaging the workpieces.

Carriers presently used to polish or hone workpieces are generally made from fiberglass, thin metal sheets or thin metal sheets coated with fiberglass. Use of metal is desirable as it provides a strong, stiff core and facilitates formation of gear teeth. However, as mentioned above, use of metal which is harder than the surface of the workpiece may cause scratching of the workpiece during processing. Such scratching can be prevented by coating the metal core with a softer material, such as fiberglass or the like.

A fiberglass-coated carrier is typically made by first creating the metal core by cutting gear teeth and apertures into a metal sheet. All dimensions and surfaces of the metal core are then filled or coated with the fiberglass material, for example, prepeg fiberglass laminate. Next, gear teeth and apertures are cut into the fiberglass material in substantially the same locations as the gear teeth and apertures in the metal core. Since the inside diameters of the fiberglass apertures are slightly smaller than the inside diameters of the metal core, it is the softer, more forgiving fiberglass material that contacts the workpiece.

Presently known methods of making coated metal carriers suffer from several shortcomings. One is that it is sometimes very difficult to align the fiberglass cut of the gear teeth with the metal gear teeth cut. Also, the gear teeth cannot be cut in the metal and fiberglass at the same time, because the bond between the fiberglass and the metal is not strong enough to withstand the tooth cutting process; i.e., the fiberglass delaminates from the metal surface when the gear teeth are simultaneously formed in both materials. Another drawback of known fiberglass coated carriers is that the fiberglass tends to break or chip off during the processing of the workpieces. These small fiberglass particles that break off may contact and scratch the surface of the workpiece and contaminate the polish pad. An improved workpiece carrier that overcomes the short comings of the prior art is desirable.

SUMMARY OF THE INVENTION

In view of the problems associated with prior-art carriers, the advantage of the present invention is the provision of a carrier that minimizes scratching of the surface of a workpiece during processing.

Another advantage of the present invention is the provision of a carrier that is relatively easy to manufacture.

These and other advantages are carried out in one form by bonding a thermoplastic material to the surface and in the workpiece pockets of a thin metal carrier. In accordance with this aspect of the invention, the risk of abrasive particles scratching the surface of the workpieces during processing is reduced by eliminating fibrous particles from the metal coating.

In accordance with another aspect of the present invention, apertures are cut into a rigid core, the rigid core is coated with a scratch-resistant material, and gear teeth are then cut into the metal and into the scratch-resistant material simultaneously. In accordance with this aspect of the present invention, the possibility of misalignment of the gear teeth is substantially reduced.

In accordance with a further aspect of the present invention, an adhesive layer is used to provide the bond of the scratch-resistant material to the rigid core of the carrier.

BRIEF DESCRIPTION OF THE DRAWING FIGURES

The present invention will hereinafter be described in conjunction with the appended drawing figures, wherein like numerals denote like elements, and:

DETAILED DESCRIPTION OF PREFERRED EXEMPLARY EMBODIMENT

The subject invention relates to carriers for use in processing workpieces. Although the workpiece to be processed may comprise virtually any device requiring a controlled surface, the present invention is conveniently described with reference to computer hard discs that require controlled surface finishes. It will be understood, however, that the invention is not limited to any particular type of workpiece or any particular type of surface finish.

Figure 1:
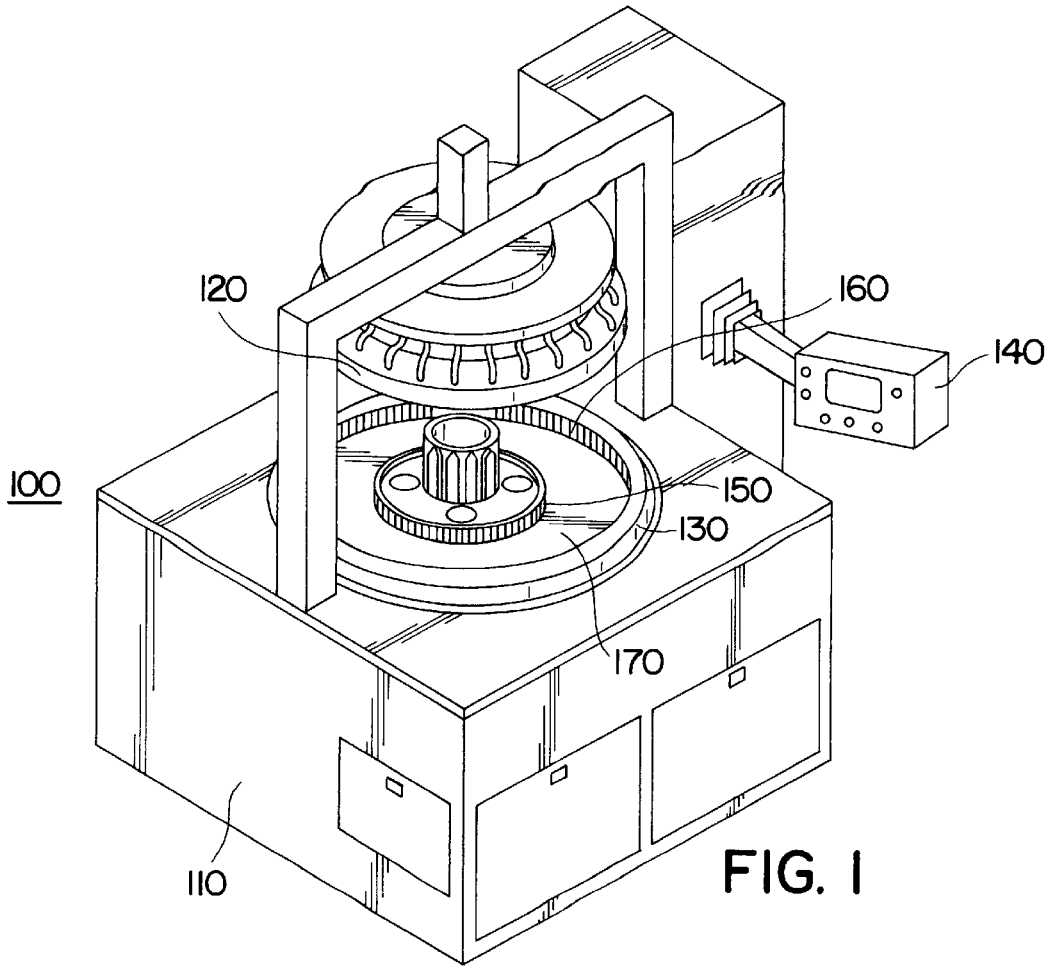
FIG. 1 is a perspective view of an exemplary honing machine.
Figure 2:
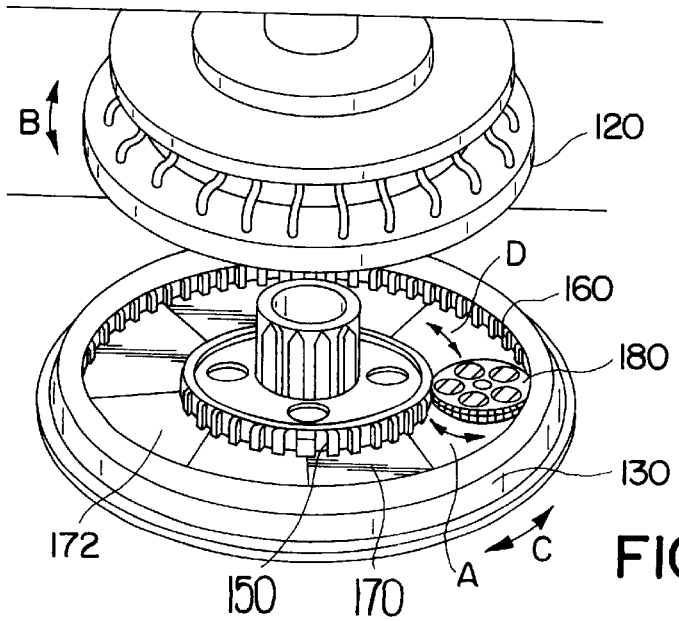
FIG. 2 is an exploded, perspective view of a top portion of the honing machine of FIG. 1.

Referring now to FIGS. 1 and 2, an exemplary honing machine 100 is shown. The exemplary workpiece honing machine 100 is configured to remove material from a workpiece (not shown in FIGS. 1 and 2), and suitably comprises a base 110, an upper platen 120, a lower platen 130 and a control panel 140 that is used to program the honing apparatus. Lower platen 130 suitably comprises a sun gear 150, and a ring gear 160. Each platen 120 and 130 includes a honing member 170, (e.g., an abrasive stone) fixedly attached to one surface.

Referring now to FIG. 2, to commence polishing or honing of the workpieces with honing machines, one or more workpieces are placed in a wafer carrier 180 that is disposed between upper platen 120 and lower platen 130 and between sun gear 150 and ring gear 160. Upper platen 120 is then lowered onto the workpiece, so that honing member 170 on upper platen 120 and polishing member 170 on lower platen 130 each contact the workpieces held by carrier 180. Polishing or honing occurs when upper platen 120 and lower platen 130 are rotated relative to the workpieces. In addition, a slurry-type liquid, which typically contains additional suspended abrasive particles and which may chemically react with the surface of the workpiece, may also be present during honing to enhance the effectiveness of the honing process. Also, a coolant such as deionized water is typically added during the processing to help remove debris from the surface of the workpiece, as well as to keep the workpiece cool during processing. Other honing or polishing agents may be used during processing to adjust workpiece removal rates or adjust uniformity of stock removal across a workpiece.

Still referring to FIG. 2, honing members 170 on platens 120, 130 each include a plurality of generally pie-shaped abrasive stone segments 172. It should be noted, however, that any suitable shape or configuration of honing member may be used; for example, a one-piece grinding stone may be used. In accordance with the illustrated embodiment in FIG. 2, each stone segment 172 is fixedly mounted to platens 120, 130, so that the stone segments 172 are secured thereon, preventing them from moving when normal operating stresses occur.

Workpieces are placed in carrier 180 during processing. Carrier 180 is suitably configured to rotate, orbit, or a combination thereof across the polishing members. In addition, honing member 170 may also rotate during processing to enhance honing efficiency and precision. The directions of rotation of carrier 180 and platens 120 and 130 are indicated, respectively, by arrows A, B and C. Moreover if sun gear 150 and ring gear 160 (i.e., the gears that cause carrier 180 to rotate and orbit) rotate at different speeds, i.e., at different radians per minute, carrier 180 will orbit or translate around the honing member in the directions indicated by arrow D. As a result, both oppositely disposed surfaces of each workpiece may be processed simultaneously, obtaining a desirably uniform and predictable removal rate from each side.

Figure 3:
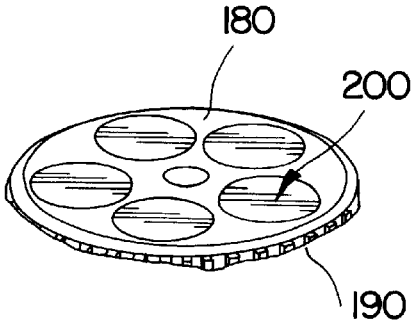
FIG. 3 is a perspective view of a workpiece carrier embodying the present invention.

Referring now to FIGS. 2 and 3, carrier 180 will be discussed in greater detail. Carrier 180 is configured to hold and support workpieces during processing. In accordance with a preferred embodiment, carrier 180 includes gear teeth 190 that are configured to mate with the gear teeth on sun gear 150 and ring gear 160 of honing machine 100. Carrier 180 further includes a plurality of apertures 200 that are configured to securely receive the workpieces, yet expose two oppositely disposed surfaces of the workpiece to honing members 170 on platens 120, 130.

Figure 4:
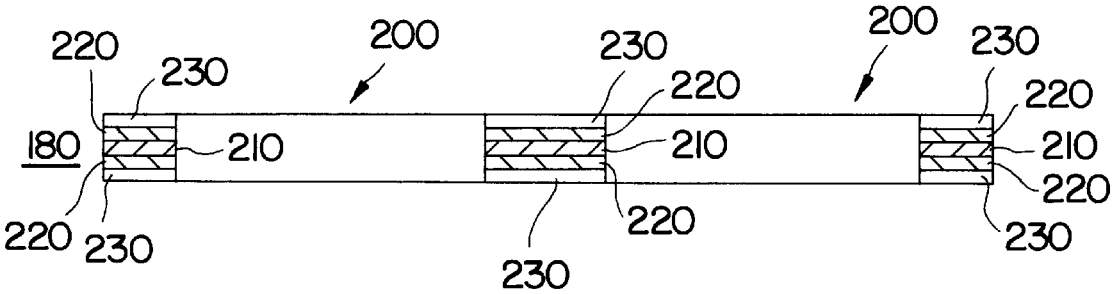
FIG. 4 is a sectional view of the workpiece carrier of FIG. 3.

Referring now to FIG. 4, carrier 180 suitably includes a rigid core 210 that is coated with a scratch-resistant material 230. Core 210 may be formed from any rigid material, including untempered 1075 spring steel, blue steel, tempered boron-carbide reinforced aluminum, 308 stainless steel, 316 stainless steel, or the like. In accordance with the preferred embodiment of the invention, core 210 is made from untempered 1075 spring steel and is in the range of about 0.007" to about 0.015" thick and more preferably about 0.012" thick.

Core 210 is suitably coated with a scratch-resistant material or film 230 that will not break off and scratch the surface of the workpiece during processing. Preferably, scratch-resistant film 230 includes a fiber-free plastic fluorocarbon material that adheres to the rigid core. In a preferred exemplary embodiment of the invention, the metal core is first coated with an adhesive layer 220 before film 230 is applied. Adhesive layer 220 may be any suitable adhesive material. However, in accordance with a preferred embodiment of the present invention, adhesive layer 220 is a Chemfab Corp. proprietary thermal stabilized primer containing a fluoropolymer. In addition, the preferred embodiment of film 230 comprises Chemfab's Chem Film 130× 600-1, a multi layer perfluoropolymer film containing homopolymers of tetrafluoroethylene and hexafluoropropylene, as described in U.S. Pat. No. 4,883,716, and incorporated herein by reference.

Scratch-resistant material 230 may include various different materials, but, preferably, it is a material that will not react with the workpieces, slurries, or coolants used during the polishing process, such as, for example, polytetrafluoroethylene (PTFE). Moreover, scratch-resistant film 230 is suitably configured to form a strong mechanical bond with adhesive layer 220, and metal 210.

In a preferred exemplary embodiment of the invention, carrier 180 is manufactured by first cutting suitable apertures 200 in rigid core material 210. The inside diameter of apertures 200 must be large enough to allow the workpieces to fit within the apertures after adhesive layer 220 and scratch-resistant film 230 have been applied and trimmed. For example, in accordance with a preferred embodiment, in order to process 95 mm diameter workpieces, apertures 200 in core 210 are typically in the range of about 95 to about 100 mm and preferably about 99 mm in diameter.

After apertures 200 have been cut into rigid core 210, an adhesive layer 220 and scratch-resistant film 230 are applied to rigid core 210. In a preferred embodiment, scratch-resistant film 230 and adhesive layer 220 are attached to core 210 by hot pressing the materials at a temperature in the range of about 400–700° F. and preferably at about 550° F. Similarly, pressure is applied during the bonding process at about 5–20 psi, and preferably about 14 psi.

Adhesive layer 220 and scratch-resistant film 230 can be applied separately or they may be purchased as an integral unit; for example, a gradient film material manufactured by ChemFab of New Hampshire. In accordance with this aspect of the invention, a single gradient film which includes an adhesive layer and a layer of PTFE may be bonded to core 210 by applying the adhesive side of the gradient film in contact with rigid core 210 and then hot pressing it onto the core in the manner discussed above. The thickness of rigid core 210 is typically in the range of about 0.005" to about 0.015", and preferably about 0.010". Similarly, the thickness of adhesive layer 220 is in the range of about 0.0005" to about 0.0015", and preferably about 0.001", and the thickness of scratch-resistant film 230 is in the range of about 0.001" to about 0.010", and preferably about 0.005". In accordance with yet an alternative embodiment of the invention, core 210 may be coated with a fluoropolymer adhesive emulsion and baked at 550° F.

After the scratch-resistant surface has been bonded to the rigid core, apertures 200 substantially concentric to but smaller than the initial apertures are cut into the scratch-resistant material on the rigid core. For a 95 mm workpiece, the inside diameter of aperture 200 of the scratch-resistant material is preferably in the range of about 95.1 mm to about 96 mm, and is most preferably about 95.5 mm.

Next, gear teeth 190 are cut into the scratch-resistant material and the rigid core layers simultaneously. Teeth 190 may be cut using a milling or hobbing technique. As one skilled in the art will appreciate, because the scratch-resistant material is firmly bonded to rigid core 210, the cutting process does not cause the material to delaminate from the core.

It will be understood that the foregoing description is of preferred exemplary embodiments of the invention and that the invention is not limited to the specific forms shown or described herein. Various modifications may be made in the design, arrangement, and type of elements disclosed herein without departing from the scope of the invention as expressed in the appended claims.

I claim:

1. A carrier for supporting a workpiece during honing or grinding of said workpiece, said carrier comprising:

a rigid core wherein said rigid core comprises a first aperture configured to receive said workpiece;

a film, wherein said film comprises an adhesive side and a thermoplastic side, and wherein said adhesive side is bonded to said rigid core.

2. The carrier of claim 1, further comprising a second aperture, said second aperture being configured to receive a workpiece and formed in said film.

3. The carrier of claim 2, wherein said second aperture is substantially concentric with said first aperture.

4. A method for making a carrier for supporting a workpiece to be honed, said method comprising:

providing a sheet of rigid material;

forming a first aperture in said rigid material wherein said first aperture is configured to receive said workpiece;

placing an adhesive film on said rigid material;

placing a thermoplastic film on said adhesive film;

hot pressing said adhesive film and said thermoplastic film onto said rigid material;

forming a second aperture in said thermoplastic film and said adhesive layer; and forming teeth in said carrier.

5. The method of claim 4, where in said second aperture is formed substantially concentric with said first aperture in said rigid material.

6. A method for making a carrier for supporting a workpiece to be honed, said method comprising:

providing a sheet of rigid material;

forming a first aperture in said rigid material wherein said first aperture is configured to receive said workpiece;

placing a film on said rigid material, wherein said film comprises an adhesive layer and a thermoplastic layer;

hot pressing said film onto said rigid material;

forming a second aperture in said film wherein said second aperture is substantially concentric with said first aperture in said rigid core; and forming teeth in said film and said rigid core.

* * * * *